US007942628B2

(12) United States Patent
Takahashi et al.

(10) Patent No.: US 7,942,628 B2
(45) Date of Patent: May 17, 2011

(54) TURBO COMPRESSOR

(75) Inventors: Toshio Takahashi, Tokyo (JP); Yutaka Hirata, Tokyo (JP); Kazuaki Kurihara, Tokyo (JP); Nobusada Takahara, Tokyo (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 525 days.

(21) Appl. No.: 11/566,337

(22) Filed: Dec. 4, 2006

(65) Prior Publication Data

US 2007/0147984 A1 Jun. 28, 2007

(30) Foreign Application Priority Data

Dec. 28, 2005 (JP) ..... 2005-377198

(51) Int. Cl.
*F01D 3/02* (2006.01)

(52) U.S. Cl. ..... 415/100; 415/116; 415/206; 416/199

(58) Field of Classification Search ..... 415/100, 415/116, 204, 205, 206; 416/199
See application file for complete search history.

(56) References Cited

U.S. PATENT DOCUMENTS

| | | | | |
|---|---|---|---|---|
| 1,012,271 | A * | 12/1911 | Paul | 415/100 |
| 1,129,139 | A * | 2/1915 | Sulzer | 415/100 |
| 1,525,736 | A * | 2/1925 | Hollander | 415/100 |
| 1,628,841 | A * | 5/1927 | Hollander | 415/94 |
| 1,662,443 | A * | 3/1928 | Sperry | 415/100 |
| 1,998,754 | A * | 4/1935 | Dorer | 415/100 |
| 2,391,811 | A | 12/1945 | Wilhelm | |
| 2,804,826 | A | 9/1957 | Cilker | |
| 2,995,092 | A | 8/1961 | Thomas et al. | |
| 3,176,620 | A | 4/1965 | Shiley | |
| 3,898,793 | A | 8/1975 | Nakamura et al. | |
| 6,062,028 | A | 5/2000 | Arnold et al. | |
| 6,499,955 | B2 | 12/2002 | Choi et al. | |
| 6,709,236 | B1 | 3/2004 | Holzer | |
| 6,739,845 | B2 | 5/2004 | Woollenweber | |
| 6,920,754 | B2 | 7/2005 | Arnold et al. | |
| 6,997,686 | B2 * | 2/2006 | Agrawal et al. | 417/350 |
| 2002/0037215 | A1 | 3/2002 | Choi et al. | |

FOREIGN PATENT DOCUMENTS

| | | |
|---|---|---|
| CN | 2445117 A | 8/2001 |
| CN | 1346020 A | 4/2002 |
| JP | 05-223090 | 8/1993 |
| JP | 2002-327700 | 11/2002 |

OTHER PUBLICATIONS

Office Action mailed Jun. 1, 2009 in co-pending related U.S. Appl. No. 11/566,428.

English translation of Notice of Rejection issued in related co-pending Chinese Application dated May 9, 2008.

* cited by examiner

*Primary Examiner* — Edward Look
*Assistant Examiner* — Ryan H Ellis
(74) *Attorney, Agent, or Firm* — Griffin & Szipl, P.C.

(57) ABSTRACT

A first compression stage and a second compression stage being arranged at positions adjacent to each other. The first centrifugal impeller and the second centrifugal impeller are arranged in such an orientation that back sides of the first centrifugal impeller and the second centrifugal impeller face to each other. A connection flow path is formed in the first housing and the second housing for introducing the compressed fluid from the first compression stage into the second compression stage. An upstream portion of the connection flow path is formed integrally with the first housing, and a downstream portion of the connection flow path is formed integrally with the second housing.

18 Claims, 6 Drawing Sheets

TURBO COMPRESSOR

This application claims priority from Japanese Patent Application No. 2005-377198, filed Dec. 28, 2005, the entire disclosure of which is incorporated herein by reference.

BACKGROUND OF THE INVENTION

1. Technical Field of the Invention

The present invention relates to a turbo compressor, and more particularly to a turbo compressor in which two centrifugal impellers are fixed to one rotating shaft in such an orientation that their back sides face to each other.

2. Description of the Related Art

In a refrigerating machine, there is employed a centrifugal compressor, so-called turbo compressor, for compressing a coolant gas serving as a working fluid so as to bring the compressor into a high temperature and high pressure state.

Meanwhile, in the compressor, if a compression ratio is higher, a discharge temperature of the compressor becomes higher and a volumetric efficiency is lowered. Particularly, if the evaporation temperature becomes lower, the compression ratio becomes higher, and accordingly, there is a case that a compressing operation is divided into two stages, three stages or more stages. The turbo compressor in which the compressing operation is executed by multi stages in this manner is called as a multistage turbo compressor.

In a two-stage turbo compressor, there has been known a structure in which two centrifugal impellers are fixed to one rotating shaft in the same orientation, and also a structure in which two centrifugal impellers are fixed to one rotating shaft in such an orientation that their back sides face to each other. As a prior art thereof, there is a structure disclosed in the following patent document 1, and the structure is shown in FIG. 1.

This turbo compressor 80 is constituted as a one-shaft two-stage compressor in which a first stage compression impeller blade (a centrifugal impeller) 83 is fixed to one end of a motor shaft 82 rotatably provided in a housing 81, and a second stage compression impeller blade 84 is fixed to the other end of the motor shaft 82 mentioned above. A coolant gas is compressed by the first stage compression impeller blade 83, and is introduced into the second stage compression impeller blade 84 through a piping 85.

As mentioned above, in the turbo compressor in which two centrifugal impellers are fixed in such an orientation that their back sides face to each other, since inlets of both the centrifugal impellers face in the opposite directions, it is general that the flow path between both the centrifugal impellers is formed by a piping connecting the centrifugal impellers.

Meanwhile, in the multi-stage turbo compressor, there is a structure in which an intermediate suction flow path for introducing a gas is provided in an intermediate stage or a final stage between a suction port and a discharge port. For example, in a multi-stage turbo compressor for a refrigerator used for a refrigerating cycle having an economizer, the coolant gas from the economizer is mixed with the coolant gas compressed on the low pressure compression stage such that the mixed gas is recompressed on the high pressure compression stage. The turbo compressor mentioned above is disclosed, for example, in the following patent document 2, and a structure thereof will be shown in FIG. 2.

This turbo compressor 90 is a two-stage turbo compressor in which two centrifugal impellers 91 and 92 are fixed to one rotating shaft 93 in the same orientation. In the turbo compressor 90, a ring-shaped entirely circumferential suction chamber 96 is provided in an intermediate stage impeller inlet passage 95 within a casing 94 such that a gas supplied from an intermediate suction port 97 is introduced into the impeller inlet passage 95. A flow guide 98 constituted by a separator plate and a pair of guide plates is arranged in a portion just near the suction port of the chamber 96.

Thereby, the gas is uniformly supplied from the circumferential direction so as to be uniformly mixed with a main stream, by the entirely circumferential suction chamber 96 and the flow guide 98.

In this case, in FIG. 2, reference symbols A and B denote bearings, reference numeral 99 denotes a motor, reference numeral 100 denotes an output shaft of the motor, reference numeral 101 denotes a large gear fixed to the output shaft 100, and reference numeral 102 denotes a small gear fixed to the rotating shaft 93.

Patent document 1: Japanese Laid-Open Patent Publication No. 5-223090

Patent document 2: Japanese Laid-Open Patent Publication No. 2002-327700

In the turbo compressor in which two centrifugal impellers are fixed to one rotating shaft in such an orientation that their back sides face to each other, such as the prior art shown in the patent document 1 mentioned above, it is general that the flow path between both the centrifugal impellers is connected by the piping.

However, in the case that the flow path between both the centrifugal impellers is connected by the piping as mentioned above, the diameter of the piping and the shape of the curvature affect the structure, and therefore, there is a problem that a product is increased in size and weight.

Further, since the piping itself forms an independent part, the number of parts is increased, and an assembling work time is additionally necessary. Accordingly, there is a problem that a cost increase is caused.

Further, in the prior art shown in the patent document 2 mentioned above, the entirely circumferential suction chamber and the flow guide are provided for introducing the coolant gas from the economizer into the flow path between two centrifugal impellers for uniformly mixing it with the main stream. However, since the special structure and parts are necessary, there is a problem that a cost increase is caused.

Further, since the prior art shown in the patent document 2 relates to the turbo compressor in which two centrifugal impellers are fixed to one rotating shaft in the same orientation, it is impossible to apply the structure in which the coolant gas and the main stream are uniformly mixed, to the turbo compressor in which two centrifugal impellers are fixed to one rotating shaft in such an orientation that their back sides face to each other. Accordingly, in the turbo compressor in which two centrifugal impellers are fixed to one rotating shaft in such an orientation that their back sides face to each other, an effective means for uniformly mixing the coolant gas (injection gas) from the economizer with the main stream is necessary.

SUMMARY OF THE INVENTION

The present invention is made by taking the circumstances mentioned above into consideration, and an object of the present invention is to provide a turbo compressor in which two centrifugal impellers are fixed to one rotating shaft in such an orientation that their back sides face to each other, wherein it is possible to connect a flow path between both the centrifugal impellers without enlarging a size of a device and without increasing the number of parts, and it is possible to uniformly mix an injected gas with a main stream.

In order to achieve the object mentioned above, the turbo compressor in accordance with the present invention employs the following means.

That is, in accordance with the present invention, there is provided a turbo compressor comprising: a first compression stage for sucking and compressing a fluid, having a first centrifugal impeller and a first housing surrounding the first centrifugal impeller; and a second compression stage for further compressing the compressed fluid from the first compression stage, having a second centrifugal impeller coupled to the first centrifugal impeller via a rotating shaft and a second housing surrounding the second centrifugal impeller, the first compression stage and the second compression stage being arranged at positions adjacent to each other, wherein the first centrifugal impeller and the second centrifugal impeller are arranged in such an orientation that back sides of the first centrifugal impeller and the second centrifugal impeller face to each other, a connection flow path is formed in the first housing and the second housing for introducing the compressed fluid from the first compression stage into the second compression stage, and an upstream portion of the connection flow path is formed integrally with the first housing, and a downstream portion of the connection flow path is formed integrally with the second housing.

In this manner, since the connection flow path is formed for introducing the compressed fluid from the first compression stage into the second compression stage, the upstream portion of the connection flow path is formed integrally with the first housing within the first housing, and the downstream portion is formed integrally with the second housing within the second housing, it is not necessary to separately provide a pipe for connecting the first compression stage to the second compression stage. Further, in the case that the flow path is integrally formed as mentioned above, conditions such as the diameter of the flow path, the shape of the curvature or the like less affect the dimension of the products, as compared with the case that the pipe is attached as a separate part, and a minimum flow path structure is obtained. Accordingly, it is possible to manufacture the product in a compact size and with a light weight.

Further, since it is not necessary to separately attach a pipe, it is possible to reduce the number of parts, it is possible to shorten an assembling work time at that degree, and a cost reduction is caused.

Further, in the turbo compressor in accordance with the present invention, the first housing has a first scroll chamber surrounding the first centrifugal impeller and into which the fluid from the first centrifugal impeller is introduced, and an outlet flow path communicating with an end portion of the first scroll chamber and open to the second housing side, the second housing has: an introduction flow path curved from an axial direction to a radial direction and open to the first housing side to communicate with the outlet flow path such that the compressed fluid from the first compression stage is introduced thereinto; and a suction scroll chamber annularly surrounding a periphery of the rotating shaft for expanding the fluid from the introduction flow path in a circumferential direction; and a suction flow path for introducing the fluid from the suction scroll chamber into the second impeller, and the connection flow path is formed by the outlet flow path and the introduction flow path.

In this manner, owing to the provision of the first scroll chamber, the outlet flow path, the introduction flow path, the suction scroll and the suction flow path structured as mentioned above, even in the turbo compressor in which the first centrifugal impeller and the second centrifugal impeller are arranged in such an orientation that their back sides face to each other, it is possible to integrally form the flow path from the outlet of the first centrifugal impeller to the inlet of the second centrifugal impeller, and it is possible to introduce the compressed fluid from the first compression stage into the second compression stage without attaching a separate pipe.

Further, in the turbo compressor mentioned above, the first scroll chamber is formed by an inner scroll chamber surrounding the first centrifugal impeller and into which the fluid from the first centrifugal impeller is introduced, and an outer scroll chamber positioned on an outer side in a radial direction than the inner scroll chamber to communicate with an outlet portion of the inner scroll chamber, the outer scroll chamber extending in a circumferential direction so as to at least partially surround the inner scroll chamber, having a cross sectional flow path area larger than that of the inner scroll chamber, and forming the connection flow path together with the outlet flow path and the introduction flow path, and the outer scroll chamber, the outlet flow path and the introduction flow path are formed so as to have flow path cross sections of a quadrilateral shape.

In this manner, since the outer scroll chamber having the cross sectional flow path area larger than that of the inner scroll chamber is formed on the outer side of the inner scroll chamber, and the fluid is introduced into the outlet flow path and the introduction flow path in which the curved portion of the flow path is formed, after lowering the speed of the fluid in the outer scroll chamber, it is possible to suppress generation of a fluid loss caused by fluid peeling.

Further, since the outer scroll chamber, the outlet flow path and the introduction flow path are formed in such a manner that each of the flow path cross sections is formed in the quadrilateral shape, it is possible to make outer dimensions of the first housing and the second housing small while securing the flow path area.

Further, in the turbo compressor mentioned above, a curved portion of the connection flow path is formed as a gradually curved flow path so as to suppress peeling by fluid.

As mentioned above, since the curved portion of the connection flow path is formed as the gradually curved flow path in such a manner as to suppress the fluid peeling, it is possible to suppress reduction of a compression performance.

Further, in the turbo compressor mentioned above, the first housing or the second housing is provided with a gas injection portion for additionally injecting a gas to the connection flow path.

As mentioned above, since the gas injection portion for additionally injecting the gas to the connection flow path is provided, the gas injected to the connection flow path is mixed with the main stream (the compressed fluid) flowing within the connection flow path, and thereafter expands in the circumferential direction in the suction scroll chamber of the second housing. Accordingly, it is possible to introduce the mixed fluid to the second centrifugal impeller in a state in which the main stream and the injection gas are uniformly mixed in the circumferential direction.

Accordingly, even in the turbo compressor in which the first centrifugal impeller and the second centrifugal impeller are arranged in such an orientation that their back sides face to each other, it is possible to uniformly mix the injection gas with the main stream without necessity of any special structure and parts.

Further, since the gas is injected into the connection flow path in which the speed of the main stream is lowered to some extent, it is possible to suppress the fluid loss generated by turbulence of the gas mixing.

Further, in the turbo compressor mentioned above, the gas injection portion has a gas injection opening formed so as to inject the gas in a direction along a fluid flow in the connection flow path.

As mentioned above, since the gas injection opening is formed in such a manner as to inject the gas in the direction extending along the fluid flow of the connection flow path, it is possible to more effectively suppress the fluid loss generated by the turbulence of the gas mixing.

Further, in the turbo compressor mentioned above, the gas injection opening is formed in the curved portion of the connection flow path.

As mentioned above, since the gas injection opening is formed in the curved portion of the connection flow path, it is possible to inject the gas to a center portion of the flow path, and it is possible to promote a uniform mixing.

In accordance with the turbo compressor of the present invention, in the turbo compressor in which two centrifugal impellers are fixed to one rotating shaft in the direction in which the back surface sides face to each other, there can be obtained an excellent effect that it is possible to connect the flow paths between both the centrifugal impellers without enlarging the size of the device and without increasing the number of the parts, and it is possible to uniformly mix the injection gas with the main stream.

The other objects and advantages of the present invention will be apparent from the following description with reference to the accompanying drawings.

DESCRIPTION OF PREFERABLE EMBODIMENTS

Figure 1:
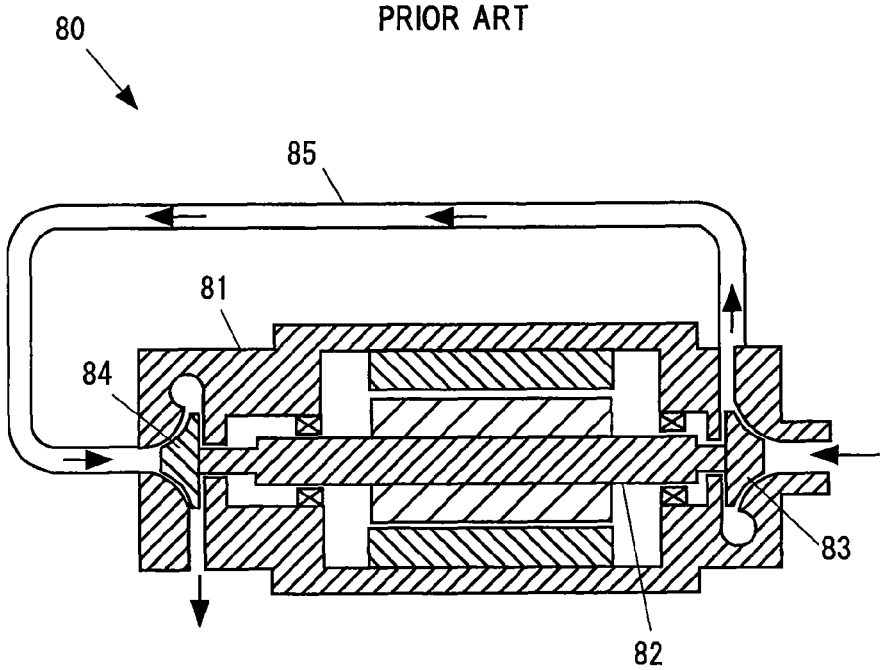
FIG. 1 PRIOR ART
FIG. 1 is a view showing a structure of a conventional turbo compressor.
Figure 2:
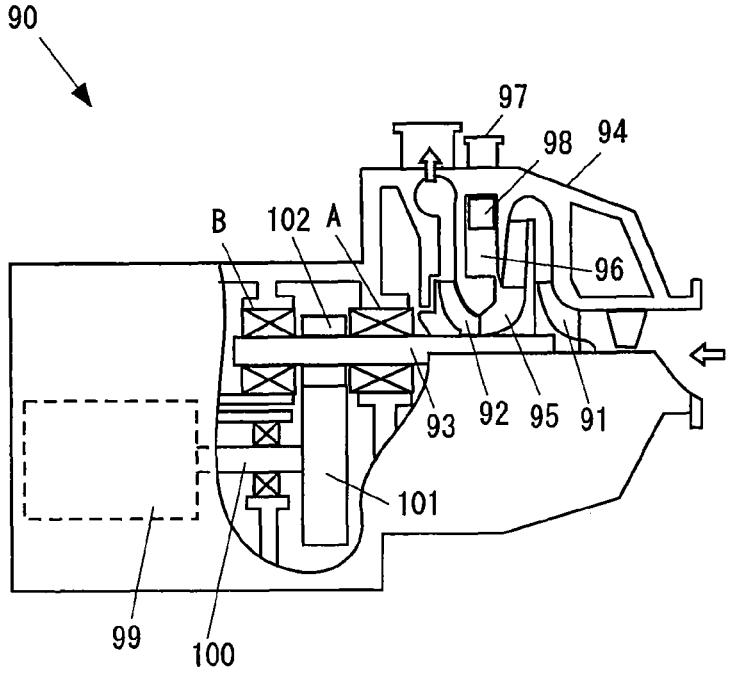
FIG. 2 PRIOR ART
FIG. 2 is a view showing a structure of a conventional turbo compressor.

The description will be in detail given below of preferable embodiments in accordance with the present invention with reference to the accompanying drawings. In this case, the same reference numerals are attached to the common portions in each of the drawings, and the repeated description will be omitted.

Further, the present invention is described below as a turbo compressor for a refrigerator, however, the applied range of the present invention is not limited to this, but the present invention can be applied to a centrifugal type turbo compressor used in the other industrial machines and compressing a fluid.

Figure 3:
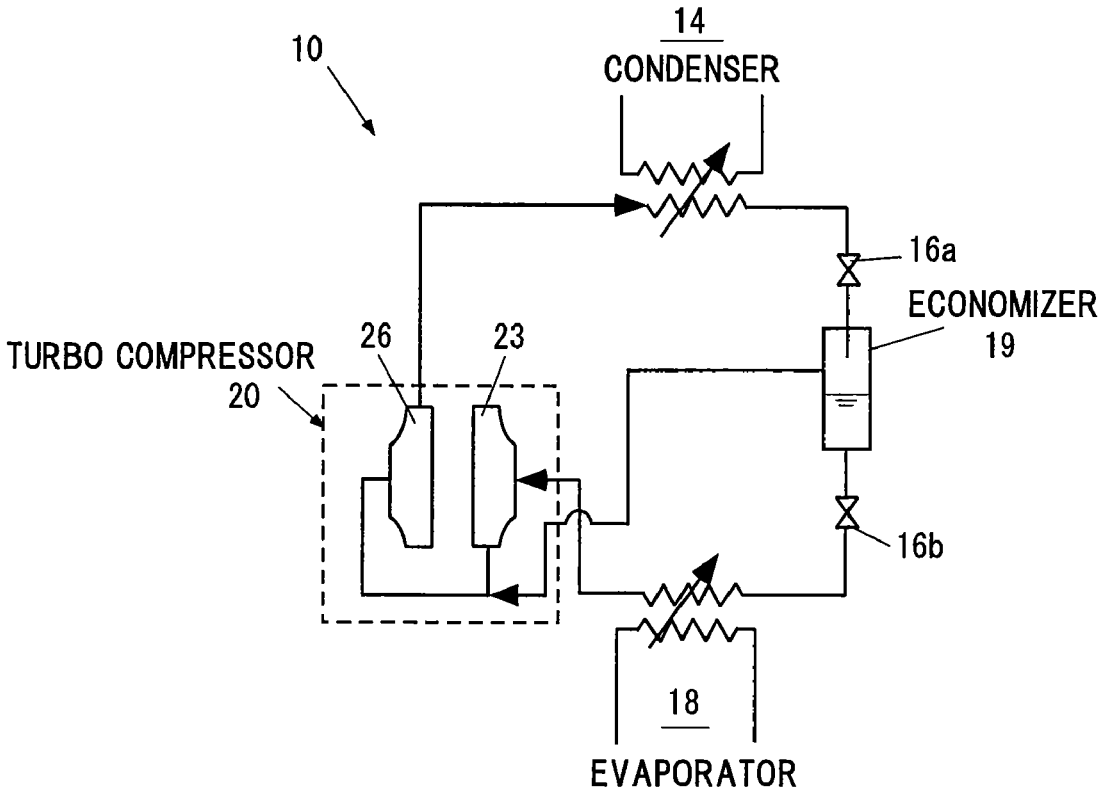
FIG. 3 is a view showing a structure of a refrigerating circuit of a turbo refrigerator to which a turbo compressor in accordance with the present invention is applied.

FIG. 3 is a view showing an arrangement of a refrigerating circuit of a turbo refrigerator 10 to which a turbo compressor in accordance with the present invention is applied.

In FIG. 3, the turbo refrigerator 10 is provided with a turbo compressor 20, a condenser 14, expansion valves 16*a* and 16*b*, an evaporator 18 and an economizer 19.

The turbo compressor 20 is a two-stage turbo compressor provided with a first centrifugal impeller 23 and a second centrifugal impeller 26, the coolant gas is compressed by the first centrifugal impeller 23 on the upstream side, introduced into the second centrifugal impeller 26 and further compressed, and thereafter delivered to the condenser 14.

The condenser 14 cools and liquefies the compressed high-temperature and high-pressure cooling gas into a coolant liquid.

The expansion valves 16*a* and 16*b* are respectively arranged between the condenser 14 and the economizer 19, and between the economizer 19 and the evaporator 18, for depressurizing the coolant liquid liquefied by the condenser step by step.

The economizer 19 temporarily reserves the coolant depressurized by the expansion valve 16*a* so as to cool it. A gas phase component of the coolant in the economizer 19 is introduced as an injection gas into the flow path between the first centrifugal impeller 23 and the second centrifugal impeller 26 of the turbo compressor 20.

The evaporator 18 gasifies the coolant liquid so as to form a coolant gas. The coolant gas coming out of the evaporator 18 is sucked into the turbo compressor 20.

Figure 4:
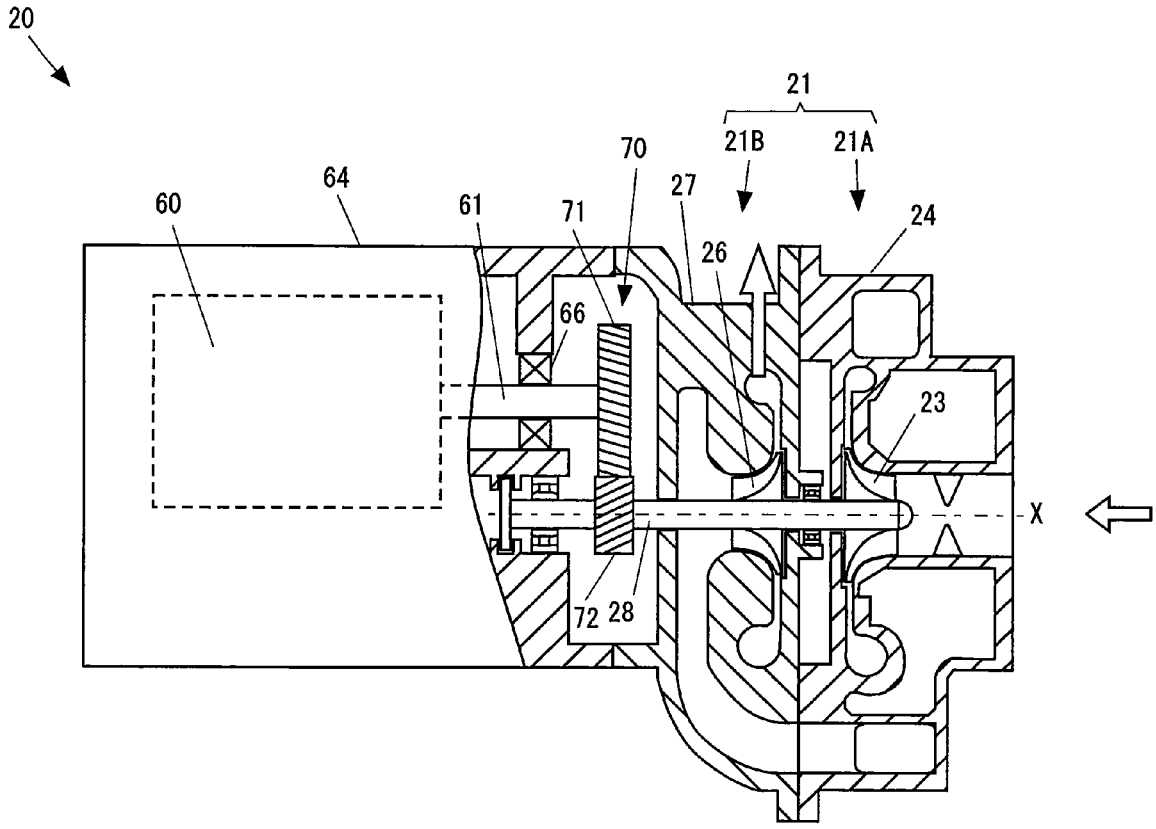
FIG. 4 is a view showing a structure of a turbo compressor in accordance with an embodiment of the present invention.

FIG. 4 is a cross sectional view showing a structure of the turbo compressor 20 in accordance with the embodiment of the present invention. As shown in FIG. 4, the turbo compressor 20 is constituted by elements such as a compressing mechanism 21, a motor 60 and a speed increasing mechanism 70.

The compressing mechanism 21 is provided with a first compression stage 21A constituted by the first centrifugal impeller 23 and a first housing 24 surrounding the first centrifugal impeller 23, and a second compression stage 21B constituted by the second centrifugal impeller 26 and a second housing 27 surrounding the second centrifugal impeller 26, the first compression stage 21A and the second compression stage 21B being arranged at positions adjacent to each other.

A rotating shaft 28 is provided in the first housing 24 and the second housing 27, and supported by bearings 50, described later, so as to be rotatable about an axis X. The first centrifugal impeller 23 and the second centrifugal impeller 26 are arranged on the rotating shaft 28 from one end side (suction side in the drawing) of the rotating shaft 28 in an axially spaced apart relationship, and in such an orientation that their back sides face to each other.

The first housing 24 and the second housing 27 are fixed to each other by a fastening means such as bolts or the like.

The motor 60 having an output shaft 61 is accommodated in a motor case 64. The motor 60 serves as a drive source rotationally driving the compressing mechanism 21.

The motor case 64 is fixed to the second housing 27 mentioned above by a fastening means such as bolts or the like.

The speed increasing mechanism 70 is housed in a space formed by the motor case 64 and the second housing 27, and is constituted by a large gear 71 fixed to the output shaft 61, and a small gear 72 fixed to the rotating shaft 28. In this case, the small gear 72 may be formed integrally with the rotating shaft 28. The rotating force of the output shaft 61 of the motor 60 is transmitted to the rotating shaft 28 by the speed increasing mechanism 70 structured mentioned above, with the speed being increased.

Figure 5:
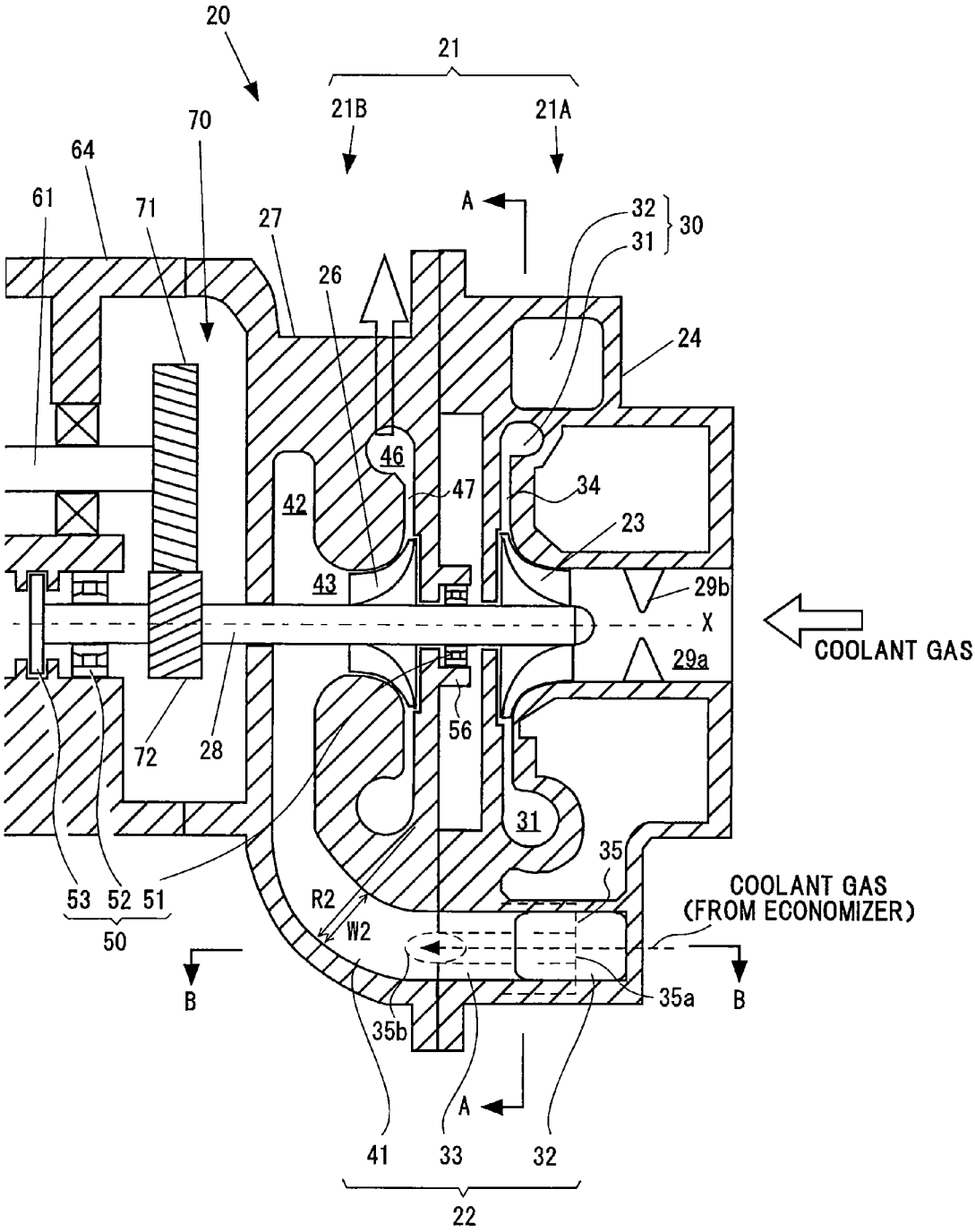
FIG. 5 is a partial enlarged view showing the structure of the turbo compressor in accordance with the embodiment of the present invention.

FIG. 5 is an enlarged view of the compressing mechanism 21 and the speed increasing mechanism 70 in FIG. 4.

As shown in FIG. 5, in the first housing 24, there is formed a suction port 29*a* for introducing the coolant gas into the first stage centrifugal impeller 23. An inlet guide blade 29*b* is provided in the suction port 29*a* for controlling the suction capacity.

A first scroll chamber 30 is formed in the first housing 24, surrounding the first centrifugal impeller 23 and into which the coolant gas from the first centrifugal impeller 23 is introduced, and the first scroll chamber 30 is constituted by an inner scroll chamber 31 and an outer scroll chamber 32.

The inner scroll chamber 31 is formed in such a manner as to annularly surround the first centrifugal impeller 23. An annular inlet side diffuser portion 34 is formed between the inner scroll chamber 31 and the first centrifugal impeller 23, extending from the outlet of the first centrifugal impeller 23 to the outer side in the radial direction, whereby the gas accelerated by the first centrifugal impeller 23 is decelerated and pressurized, and introduced into the inner scroll chamber 31.

An opening through which the rotating shaft 28 extends is formed in the back side (left side in the drawing) of the first housing 24.

The outer scroll chamber 32 is positioned on the outer side in the radial direction than the inner scroll chamber 31, and is formed such that its cross sectional flow path area is larger than that of the inner scroll chamber 31, and the cross section of this flow path is formed in a quadrilateral shape. In this case, "quadrilateral shape" does not mean a shape in which inner angles are completely right angles, but means a shape in which corners are chamfered to some extent. The chamfer is set to such an extent that peeling caused by the fluid flowing in the inner portion of the outer scroll chamber 32 is not generated. In the following, "quadrilateral shape" in the description of the other positions has the same meaning as mentioned above.

Figure 6:
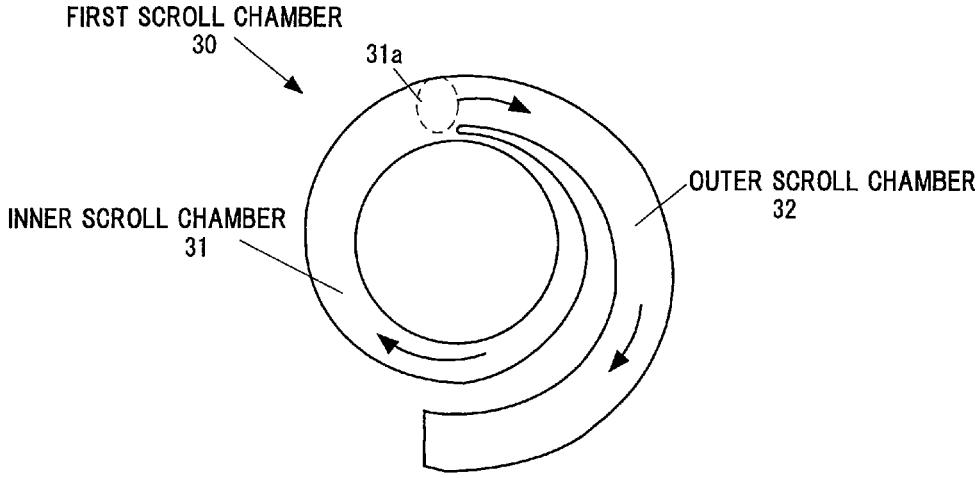
FIG. 6 is a view showing a shape of an inner scroll chamber and an outer scroll chamber in a cross section along a line A-A in FIG. 5.
Figure 7:
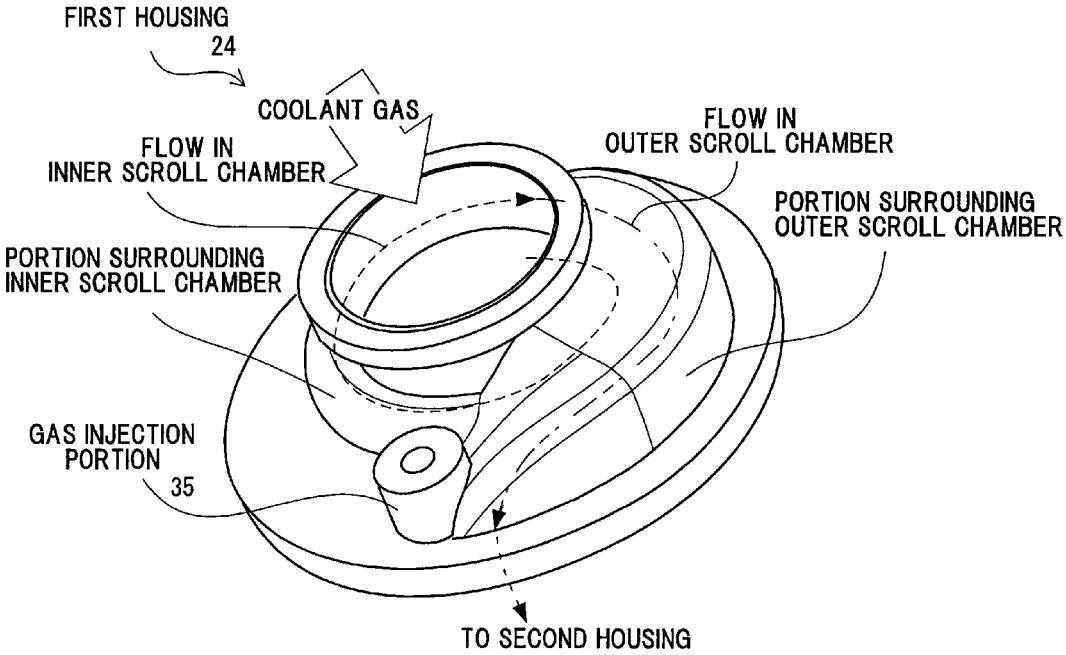
FIG. 7 is a perspective view of a first housing in the turbo compressor in accordance with the embodiment of the present invention.

FIG. 6 is a view showing the shape of the inner scroll chamber 31 and the outer scroll chamber 32 in a cross section taken along the line A-A in FIG. 5. Further, FIG. 7 is a perspective view of the first housing 24 viewed from the obliquely lower side, and shows the states of the flows in the inner scroll chamber 31 and the outer scroll chamber 32 formed within the first housing in an overlapping manner.

As shown in these drawings, the outer scroll chamber 32 is formed to communicate with an outlet portion 31*a* of the inner scroll chamber 31 and circumferentially extends so as to at least partially surround the inner scroll chamber 31, and in the illustrated embodiment, it is formed to surround about one half of the inner scroll chamber 31, around the inner scroll chamber 31.

Further, the outer scroll chamber 32 is formed integrally with the first housing 24 within the first housing 24, together with the inner scroll chamber 31, by a cast integral structure.

Figure 8:
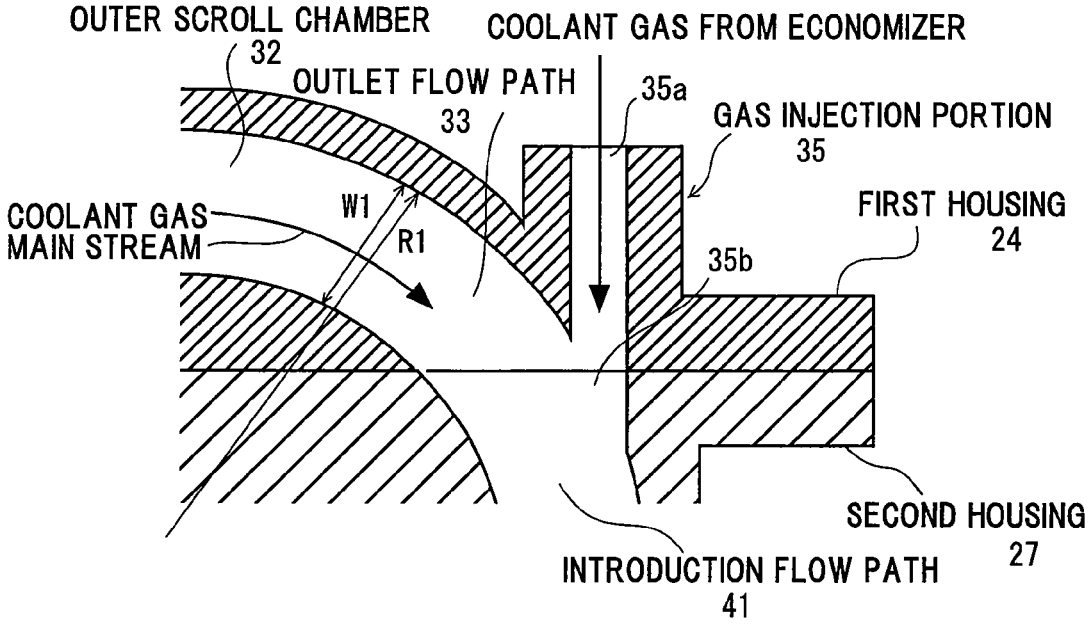
FIG. 8 is a cross sectional view along a line B-B in FIG. 5.

FIG. 8 is a cross sectional view taken along the line B-B in FIG. 5.

As shown in FIGS. 5 and 8, an outlet flow path 33 is formed in the first housing 24, being communicated with an end portion of the outer scroll chamber 32 and being open to the second housing 27 side.

The outlet flow path 33 has a flow path cross section formed in a quadrilateral shape, in the same manner as the outer scroll chamber 32, and is formed to communicate with an introduction flow path 41 provided in the second housing 27.

Further, the outlet flow path 33 is formed integrally with the first housing 24 within the first housing 24, together with the other flow paths (the outer scroll chamber 32 and the like) within the first housing 24, by a cast integral structure.

As shown in FIG. 5, the introduction flow path 41, a suction scroll chamber 42 and a suction flow path 43 are formed in the second housing 27.

The introduction flow path 41 is open to the first housing 24 side in such a manner as to communicate with the outlet flow path 33 mentioned above, and is formed so as to introduce the coolant gas from the first compression stage 21A into the second housing 27. Further, the introduction flow path 41 is formed such that the flow path cross section is formed in a quadrilateral shape, in the same manner as the outer scroll chamber 32 and the outlet flow path 33 mentioned above.

The suction scroll chamber 42 is formed so as to surround the periphery of the rotating shaft 28 annularly and causes the gas from the introduction flow path 41 to expand in the circumferential direction.

The suction passage 43 is formed annularly in such a manner as to guide the gas in the suction scroll chamber 42 radially inward, and then to change its course toward the first centrifugal impeller 23 side, so as to introduce the gas to the second centrifugal impeller 26.

Further, an annular outlet side scroll chamber 46 is formed in the second housing 27, surrounding the second centrifugal impeller 26. Between the outer scroll chamber 46 and the second centrifugal impeller 26, there is formed an annular outside diffuser portion 47 extending in a radial direction from an outlet of the second stage centrifugal impeller 26, whereby the structure is made such as to decelerate and pressurize the gas accelerated by the second centrifugal impeller 26 so as to introduce it to the outlet side scroll chamber 46.

An opening through which the rotating shaft 28 extends is formed in the back side (right side in the drawing) of the second housing 27.

The introduction flow path 41 mentioned above is formed integrally with the second housing 27 within the second housing 27, together with the other flow paths (the suction scroll chamber 42 and the like) within the second housing 27, by a cast integral structure.

The connection flow path 22 for introducing the compressed fluid from the first compression stage 21A to the second compression stage 21B is constituted by the outer scroll chamber 32, the outlet flow path 33 and the introduction flow path 41, structured as mentioned above.

A curved portion of the connection flow path 22 is formed as a gradually curved flow path in such a manner as to suppress peeling by the fluid.

Specifically, as shown in FIG. 8, the curved flow path is formed over the outer scroll chamber 32, the outlet flow path 33 and the introduction flow path 41, however, it is preferable that the flow path is formed in such a manner that a radius R1 of curvature of the curved portion at the outer position thereof in the radial direction is, for example, equal to or more than 1.5 times of a flow path width W1 in the direction of the radius R1 of curvature.

Further, as shown in FIG. 5, the introduction flow path 41 is curved in such a manner as to extend in the axial direction and then in the radial direction, and it is preferable that a radius R2 of curvature of the curved portion at the outer position thereof in the radial direction is, for example, equal to or more than 1.5 times of a flow path width W2 in the direction of the radius R2 of curvature.

As shown in FIGS. 5, 7 and 8, the compression mechanism 21 is provided with a gas injection portion 35 for additionally injecting the coolant gas from the economizer 19 (refer to FIG. 3) to the connection flow path 22 mentioned above. In this case, the gas injection portion 35 is provided at a position above the sheet of drawing and shown by an imaginary line in FIG. 5.

Further, as shown in FIGS. 5 and 8, in the present embodiment, a gas intake port 35*a* of the gas injection portion 35 is provided in the first housing 24, and a gas injection opening 35*b* blowing out the gas into the connection flow path 22 is formed in such a manner as to be astride the first housing 24 and the second housing 27.

The gas injection opening 35*b* is formed in the curved portion of the connection flow path 22 in such a manner as to inject the gas in the direction along the flow of the fluid (the main stream of the coolant gas) of the connection flow path 22.

Further, on the basis of the gas injection portion 35 structured as mentioned above, the coolant gas from the economizer 19 is mixed with the coolant gas compressed in the first centrifugal impeller 23 such that the mixed coolant gas is supplied to the second centrifugal impeller 26.

An opening position of the gas injection opening 35*b* is not limited to the position of the present embodiment, but may be set to a position of any one of the outer scroll chamber 32, the outlet flow path 33 and the introduction flow path 41, or a position being astride two of them. Further, the position at which the gas injection portion 35 is provided is set to an appropriate position of one or both of the first housing 24 and the second housing 27, in conformity to the position of the gas injection opening 35*b*.

Bearings 50 supporting the rotating shaft 28 so as to be rotatable about the axis X are arranged in the first housing 24 and the second housing 27.

As shown in FIG. 5, in the present embodiment, the bearings 50 comprise journal bearings 51 and 52 supporting the radial load applied to the rotating shaft 28 at two axially spaced supporting positions, respectively, and a thrust bearing 53 supporting the thrust load applied to the rotating shaft 28.

In the bearings 50, the journal bearing 51 (hereinafter, refer also to as "first bearing" as well) supporting one supporting position is arranged between the first centrifugal impeller 23 and the second centrifugal impeller 26, and is fixed to a bearing retaining portion 56 provided in the second housing.

Further, in the bearings 50, the journal bearing 52 (hereinafter, refer also to as "the second bearing" as well) supporting the other supporting position is arranged on the opposite side from the first centrifugal impeller 23 with respect to the second centrifugal impeller 26 in the axial direction.

Lubricating oil is supplied to these bearings 51, 52 and 53 by an oil feeding structure (not shown in the drawing), whereby the lubrication thereof is secured.

Incidentally, the journal bearings 51 and 52 and the thrust bearing 53 can be constituted by various bearings such as a slide bearing, a rolling bearing, a gas bearing, a magnetic bearing and the like.

Further, the one journal bearing 51 is not limited to be arranged at the position mentioned above, but may be arranged at a position on the opposite side from the first centrifugal impeller 23 with respect to the second centrifugal impeller 26 in the axial direction (the position on the left side of the second centrifugal impeller 26 in the drawing), in the axial positions of the rotating shaft 28. However, if it is arranged as in the present embodiment, the amount of overhang of the rotating shaft 28 is reduced, so that it is possible to increase the critical speed.

Further, in the present embodiment, the other journal bearing 52 mentioned above is arranged on the opposite side from the second centrifugal impeller 26 with respect to the position of the small gear 72 of the speed increasing mechanism 70, however, the other journal bearing 52 may be arranged between the small gear 72 and the second centrifugal impeller 26 in place of the arrangement mentioned above.

Next, the description will be given of an operation of the turbo compressor 20 structured as mentioned above.

During the operation of the turbo refrigerator 10 mentioned above, in the turbo compressor 20, the rotational driving force of the output shaft 61 of the motor 60 is transmitted to the rotating shaft 28 by the speed increasing mechanism 70, with the speed being increased, and the first centrifugal impeller 23 and the second centrifugal impeller 26 fixed to the rotating shaft 28 are rotationally driven.

The coolant gas from the evaporator 18 is sucked from the suction port 29*a* of the first housing 24, and is accelerated by the first centrifugal impeller 23. The accelerated coolant gas is decelerated and pressurized in the course of passing through the inside diffuser portion 34, and sequentially introduced into the inner scroll chamber 31 and the outer scroll chamber 32.

The coolant gas passing through the outer scroll chamber 32 flows to the second housing 27 from the first housing 24 through the outlet flow path 33 and the introduction flow path 41. Further, at this time, the coolant gas from the economizer 19 is injected from the gas injection portion 35 and mixed with the main stream.

The mixed gas uniformly expands in the suction scroll chamber 42, and is thereafter introduced into the second stage impeller 26 through the suction flow path 43 so as to be accelerated.

The accelerated coolant gas is decelerated and pressurized in the course of passing through the outside diffuser portion 47 so as to have the higher temperature and the higher pressure, and is introduced into the second scroll chamber 46, and is thereafter discharged from a discharge portion (not shown in the drawing) so as to be introduced into the condenser 14 mentioned above.

Next, the description will be given of the operation and the effect of the turbo compressor 20 in accordance with the present embodiment.

In accordance with the turbo compressor 20 of the present embodiment, since the connection flow path 22 for introducing the compressed fluid from the first compression stage 21A into the second compression stage 21B is formed, the upstream portion of the connection flow path 22 is formed integrally with the first housing 24 within the first housing 24, and the downstream portion of the connection flow path 22 is formed integrally with the second housing 27 within the second housing 27, it is not necessary to separately provide a pipe for connecting the first compression stage 21A and the second compression stage 21B. Further, in the case that the flow path is integrally formed as mentioned above, conditions such as the diameter of the flow path, the shape of the curvature or the like less affects the dimension of the product, as compared with the case that the piping is attached as a separate part, and the minimum flow path structure is obtained. Accordingly, it is possible to manufacture the product in a compact size and with a light weight.

Further, since it is not necessary to separately provide a pipe, it is possible to reduce the number of parts, it is possible to shorten an assembling work time at that degree, and a cost reduction is caused.

Further, since the first scroll chamber 30, the outlet flow path 33, the introduction flow path 41, the suction scroll 42 and the suction flow path 43 are provided, even in the turbo compressor in which the first centrifugal impeller 23 and the second centrifugal impeller 26 are arranged in such an orientation that their back sides face to each other, it is possible to integrally form the flow path from the outlet of the first centrifugal impeller 23 to the inlet of the second centrifugal impeller 26, and it is possible to introduce the compressed fluid from the first compression stage into the second compression stage, without separately providing a pipe.

Further, since the outer scroll chamber 32 having the cross sectional flow path area larger than that of the inner scroll chamber 31 is formed on the outer side of the inner scroll chamber 31, and the fluid is introduced into the outlet flow path 33 and the introduction flow path 41 in which the curved portion of the flow path is formed after the speed of the fluid is lowered by the outer scroll chamber 32, it is possible to suppress generation of a fluid loss by peeling caused by the fluid.

Further, since the connection flow path 22 (the outer scroll chamber 32, the outlet flow path 33 and the introduction flow path 41) is formed in such a manner that the flow path cross section is formed in the quadrilateral shape, it is possible to make the outer shape dimensions of the first housing 24 and the second housing 27 smaller while securing the flow path area.

Further, since the gradually curved portion of the flow path in the connection flow path 22 is formed, it is possible to suppress the peeling by the fluid within the flow path, and it is possible to suppress the reduction of the compressing performance.

Further, since the gas injection portion for additionally injecting the gas is provided in the connection flow path 22, the gas injected into the connection flow path is mixed with the main stream (the compressed fluid) flowing within the connection flow path, and thereafter expands in the circumferential direction in the suction scroll chamber 42 of the second housing 27. Accordingly, it is possible to introduce the mixed fluid to the second centrifugal impeller 26 in the state in which the main stream and the injection gas are uniformly mixed in the circumferential direction.

Accordingly, even in the turbo compressor in which the first centrifugal impeller 23 and the second centrifugal impeller 26 are arranged in such an orientation that their back sides face to each other, it is possible to uniformly mix the injection gas with the man stream in the circumferential direction without necessity of any special structure and parts.

Further, since the gas is injected into the connection flow path 22 in which the speed of the main stream is lowered to some extent, it is possible to suppress the fluid loss generated due to the turbulence of the gas mixing.

Further, since the gas injection opening 35*b* is formed in such a manner as to inject the gas in the direction along the fluid flow of the connection flow path 22, it is possible to more effectively suppress the fluid loss generated due to the turbulence of the gas mixing.

Further, since the gas injection opening 35*b* is formed in the curved portion of the connection flow path 22, it is possible to inject the gas in the center portion of the flow path, and it is possible to promote the uniform mixing.

As mentioned above, in accordance with the turbo compressor of the present invention, in the turbo compressor in which two centrifugal impellers are fixed to one rotating shaft in such an orientation that their back sides face to each other, there can be obtained an excellent operation and effect that it is possible to connect the flow path between both the centrifugal impellers without increasing the size of the device and without increasing the number of parts, and it is possible to uniformly mix the injection gas with the main stream.

Incidentally, in the embodiment mentioned above, the first compression stage 21A and the second compression stage 21B are arranged in this order from the side remote from the side to which the driving force of the rotating shaft 28 is transmitted to the rotating shaft from the motor 60. On the contrary, the structure may be made such that the first compression stage 21A and the second compression stage 21B are arranged in this order from the side to which the driving force of the rotating shaft 28 is transmitted to the rotating shaft from the motor 60.

Further, in the embodiment mentioned above, the rotationally driving force of the motor 60 is transmitted to the rotating shaft 28 via the speed increasing mechanism 70, however, the structure may be made such that the rotating shaft 28 and the output shaft 61 of the motor mechanism 60 are directly coupled, depending on the specification of a rotating speed of the motor 60 or the like.

Further, it goes without saying that the present invention is not limited to the embodiment mentioned above, but can be variously modified within the scope of the present invention.

What is claimed is:

1. A turbo compressor comprising:

(a) a first compression stage having a first centrifugal impeller and a first housing surrounding the first centrifugal impeller, wherein the first compression stage is arranged to take in fluid at an upstream portion and output compressed fluid at a downstream portion;

(b) a second compression stage arranged to further compress compressed fluid from the first compression stage, the second compression stage having a second centrifugal impeller coupled to the first centrifugal impeller via a rotating shaft and a second housing surrounding the second centrifugal impeller; and (c) a connection flow path connecting the first housing and the second housing, the connection flow path arranged to introduce compressed fluid output from the first compression stage into the second compression stage, wherein the first compression stage and the second compression stage are arranged at positions adjacent each other, wherein the first centrifugal impeller and the second centrifugal impeller are arranged such that back sides of the first centrifugal impeller and the second centrifugal impeller face to each other, wherein an upstream portion of the connection flow path is formed integrally with the first housing, and a downstream portion of the connection flow path is formed integrally with the second housing, wherein the first housing has a first scroll chamber surrounding the first centrifugal impeller and disposed so that compressed fluid from the first centrifugal impeller is introduced, and an outlet flow path open to the second housing side and communicating with an end portion of the first scroll chamber, wherein the second housing has an introduction flow path open to the first housing side, communicating with the outlet flow path and arranged such that compressed fluid from the first compression stage is introduced thereinto, wherein the first scroll chamber is formed by an inner scroll chamber surrounding the first centrifugal impeller and disposed so that compressed fluid from the first centrifugal impeller is introduced, and an outer scroll chamber positioned on an outer side in a radial direction than the inner scroll chamber and communicating with an outlet portion of the inner scroll chamber, wherein the connection flow path is formed by the outlet flow path, the introduction flow path, and the outer scroll chamber, wherein the inner scroll chamber has a cross sectional flow path area that gradually increases toward a downstream end of the inner scroll chamber, wherein the outer scroll chamber extends in a circumferential direction of the inner scroll chamber at least partially surrounding the inner scroll chamber and the outer scroll chamber has a cross sectional flow path area larger than that of the downstream end of the inner scroll chamber at a connection part between the inner scroll chamber and the outer scroll chamber, sufficient to lower speed of fluid in the outer scroll chamber, wherein the outer scroll chamber is configured so that fluid flows into the outlet flow path and then the introduction flow path that forms a curved portion of the connection flow path.

2. The turbo compressor as claimed in claim 1, wherein the outer scroll chamber surrounds about one half of the inner scroll chamber, around the inner scroll chamber.

3. The turbo compressor as claimed in claim 2, wherein the second housing has a suction scroll chamber annularly surrounding a periphery of the rotating shaft for expanding the fluid from the introduction flow path in a circumferential direction; and a suction flow path for introducing the fluid from the suction scroll chamber into the second centrifugal impeller.

4. The turbo compressor as claimed in claim 3, wherein the second housing further has an outside diffuser portion extending in a radial direction of an outlet of the second centrifugal impeller; and an outlet side scroll chamber annularly surrounding the second centrifugal impeller and connected to the outside diffuser, wherein the fluid introduced from the second centrifugal impeller is pressurized in the course of passing through the outside diffuser, and is thereafter introduced into the outlet side scroll chamber.

5. The turbo compressor as claimed in claim 4, wherein the outlet side scroll chamber is connected to a discharge portion, wherein the fluid introduced into the outlet side scroll chamber is discharged from the discharge portion.

6. The turbo compressor as claimed in claim 2, wherein the outer scroll chamber, the outlet flow path and the introduction flow path are formed so as to have flow path cross sections of a quadrilateral shape.

7. The turbo compressor as claimed in claim 2, wherein a curved portion of the connection flow path is formed as a gradually curved flow path so as to suppress peeling by fluid.

8. The turbo compressor as claimed in claim 2, wherein one of the first housing or the second housing is provided with a gas injection portion for additionally injecting a gas to the connection flow path.

9. The turbo compressor as claimed in claim 8, wherein the gas injection portion has a gas injection opening formed so as to inject the gas in a direction along a fluid flow in the connection flow path.

10. The turbo compressor as claimed in claim 8, wherein the gas injection opening is formed in the curved portion of the connection flow path.

11. The turbo compressor as claimed in claim 1, wherein the second housing has a suction scroll chamber annularly surrounding a periphery of the rotating shaft for expanding the fluid from the introduction flow path in a circumferential direction; and a suction flow path for introducing the fluid from the suction scroll chamber into the second centrifugal impeller.

12. The turbo compressor as claimed in claim 11, wherein the second housing further has an outside diffuser portion extending in a radial direction of an outlet of the second centrifugal impeller; and an outlet side scroll chamber annularly surrounding the second centrifugal impeller and connected to the outside diffuser, wherein the fluid introduced from the second centrifugal impeller is pressurized in the course of passing through the outside diffuser, and is thereafter introduced into the outlet side scroll chamber.

13. The turbo compressor as claimed in claim 12, wherein the outlet side scroll chamber is connected to a discharge portion, wherein the fluid introduced into the outlet side scroll chamber is discharged from the discharge portion.

14. The turbo compressor as claimed in claim 1, wherein the outer scroll chamber, the outlet flow path and the introduction flow path are formed so as to have flow path cross sections of a quadrilateral shape.

15. The turbo compressor as claimed in claim 1, wherein a curved portion of the connection flow path is formed as a gradually curved flow path so as to suppress peeling by fluid.

16. The turbo compressor as claimed in claim 1, wherein one of the first housing or the second housing is provided with a gas injection portion for additionally injecting a gas to the connection flow path.

17. The turbo compressor as claimed in claim 16, wherein the gas injection portion has a gas injection opening formed so as to inject the gas in a direction along a fluid flow in the connection flow path.

18. The turbo compressor as claimed in claim 16, wherein the gas injection opening is formed in the curved portion of the connection flow path.

* * * * *